US006158980A

United States Patent [19]

Tsumagari et al.

[11] Patent Number: 6,158,980

[45] Date of Patent: Dec. 12, 2000

[54] COMPRESSOR WITH MOTOR

[75] Inventors: Yuichi Tsumagari, Toyokawa; Masami Sanuki, Chiryu; Hiroyuki Gennami; Kazuhiro Kuroki, both of Kariya, all of Japan

[73] Assignees: Denso Corporation; Kabushiki Kaisha Toyoda Jidoshokki Seisakusho, both of Kariya, Japan

[21] Appl. No.: 09/325,651

[22] Filed: Jun. 4, 1999

[30] Foreign Application Priority Data

Jun. 8, 1998 [JP] Japan ..... 10-159272

[51] Int. Cl.[7] ..... F04B 17/00; F01C 1/02

[52] U.S. Cl. ..... 417/366; 418/55.6

[58] Field of Search ..... 417/366, 410.5; 418/55.6, 96

[56] References Cited

U.S. PATENT DOCUMENTS

| | | | |
|---|---|---|---|
| 4,181,474 | 1/1980 | Shaw | 417/366 |
| 4,564,339 | 1/1986 | Nakamura et al. | 417/366 |
| 4,592,703 | 6/1986 | Inaba et al. | 417/366 |
| 5,591,018 | 1/1997 | Takeuchi et al. | 417/366 |
| 5,660,539 | 8/1997 | Matsunaga et al. | 418/55.6 |
| 5,759,021 | 6/1998 | Yamaguchi et al. | 418/55.3 |
| 5,810,573 | 9/1998 | Mitsunaga et al. | 418/55.6 |
| 6,042,346 | 3/2000 | Doi | 417/371 |
| 6,050,794 | 4/2000 | Noboru et al. | 418/55.6 |
| 6,059,540 | 5/2000 | Ni | 417/295 |
| 6,062,834 | 5/2000 | Masumoto et al. | 418/55.4 |

FOREIGN PATENT DOCUMENTS 7-4374 1/1995 Japan .

*Primary Examiner*—Teresa Walberg
*Assistant Examiner*—Vinod D Patel
*Attorney, Agent, or Firm*—Pillsbury Madison & Sutro LLP

[57] ABSTRACT

Lubricant oil, separated from compressed fluid and stored in an oil storage chamber formed beneath a motor, is introduced via an internal oil supply passage to an attachment groove formed for installing a main bearing. The lubricant oil passes through the main bearing, and flows toward a compressor. The lubricant oil is also supplied to an oil supply hole formed inside a rotation shaft of the motor via lubricant oil grooves, and lubricates and cools a needle bearing. Accordingly, axial length of housing protruding portion is reduced, and thereby reducing an entire axial length of the electrically-driven compressor apparatus.

5 Claims, 3 Drawing Sheets

COMPRESSOR WITH MOTOR

CROSS REFERENCE TO RELATED APPLICATION

This application is based upon and claims priority from Japanese Patent Application No. H. 10-159272 filed Jun. 8, 1998, the contents of which are incorporated herein by reference.

BACKGROUND OF THE INVENTION

1. Field of the Invention

The present invention relates to a compressor with a motor, which includes a compressor to compress fluid such as refrigerant, and includes a motor to drive the compressor integrally combined with the compressor in its axial direction.

2. Description of Related Art

One type of known compressor with a motor is disclosed in JP-A-7-4374. The compressor disclosed in JP-A-7-4374 has a scroll-type-compressor and a motor integrally connected to the scroll-type-compressor. The fluid, such as refrigerant to be used for an air conditioning apparatus, is compressed by the scroll-type-compressor, and is guided to the outside via an internal portion of the motor.

According to the conventional compressor with the motor, lubricant oil, such as refrigerating machine oil, included in the compressed fluid for lubricating sliding portions of the compressor is separated from the compressed fluid when it passes through the internal portion of the motor, and is temporarily stored in an oil storage chamber, which is formed beneath the motor, under a discharge pressure.

A bearing for supporting a rotation shaft of the motor is installed in a periphery of a connection between the compressor and the rotation shaft. To supply the lubricant oil having the discharge pressure from the oil storage chamber to the bearing and sliding portions inside the compressor, an internal oil supply passage is formed in a protruding portion of the housing, protruding in the axial direction of the rotation shaft from the compressor toward the motor.

For the convenience of forming the internal oil passage, its one end has an opening around the rotation shaft at the periphery of a tip of the protruding portion. Thus, after the lubricant oil is introduced to the periphery of the tip of the protruding portion, it is introduced along the rotation shaft to the bearing and other sliding portions to be lubricated.

According to the conventional compressor with the motor, it has been difficult to reduce the height of the protruding portion because of the design of the internal oil passage. Accordingly, the protruding portion prevents a front end of the motor from being placed closer to the compressor. Thus, it is difficult to reduce the axial length of the entire compressor with the motor.

SUMMARY OF THE INVENTION

The present invention is made in light of the foregoing problem, and it is an object of the present invention to provide a compressor with a motor which can reduce its axial length with keeping its compressor performance.

According to an electrically-driven compressor apparatus of the present invention, lubricant oil, separated from compressed fluid and stored in an oil storage chamber formed beneath a motor, is introduced via an internal oil supply passage to an attachment groove formed on a base portion of a housing protruding portion for installing a bearing. The lubricant oil lubricates and cools the bearing, and flows to other sliding portion.

Accordingly, it is not necessary to introduce the lubricant oil to the top portion of the housing protruding portion and to introduce it along a rotation shaft. Thus, axial length of the housing protruding portion is reduced, and thereby reducing axial length of the electrically-driven compressor apparatus without compromising the compressor performance.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

A preferred embodiment of the present invention will now be described with reference to the accompanying drawings.

Figure 1:
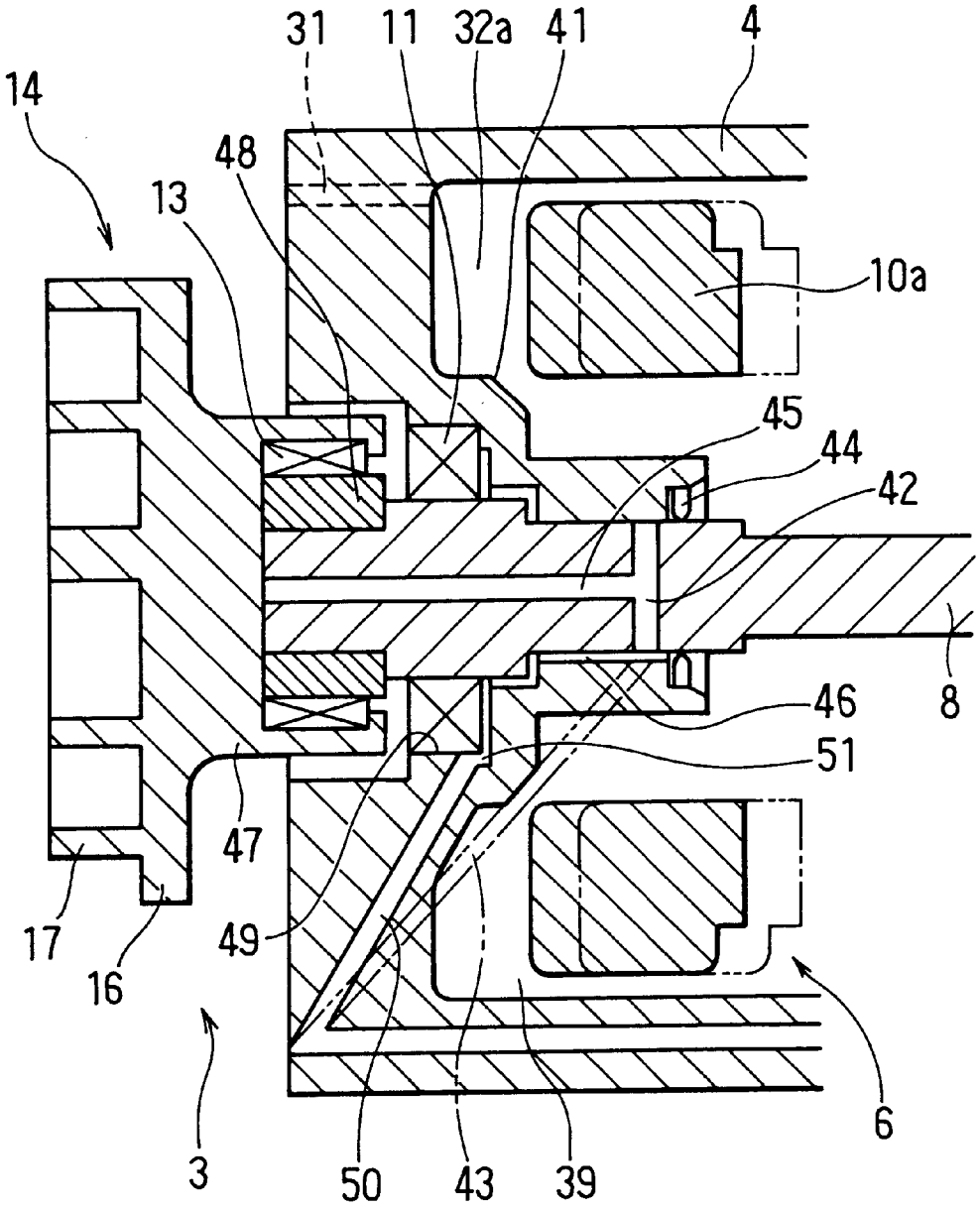
FIG. 1 is a main part of a sectional view of a compressor according to a preferred embodiment of the present invention.

The preferred embodiment, in which the present invention is applied to an electrically-driven scroll type compressor, is shown in FIG. 1.

Figure 2:
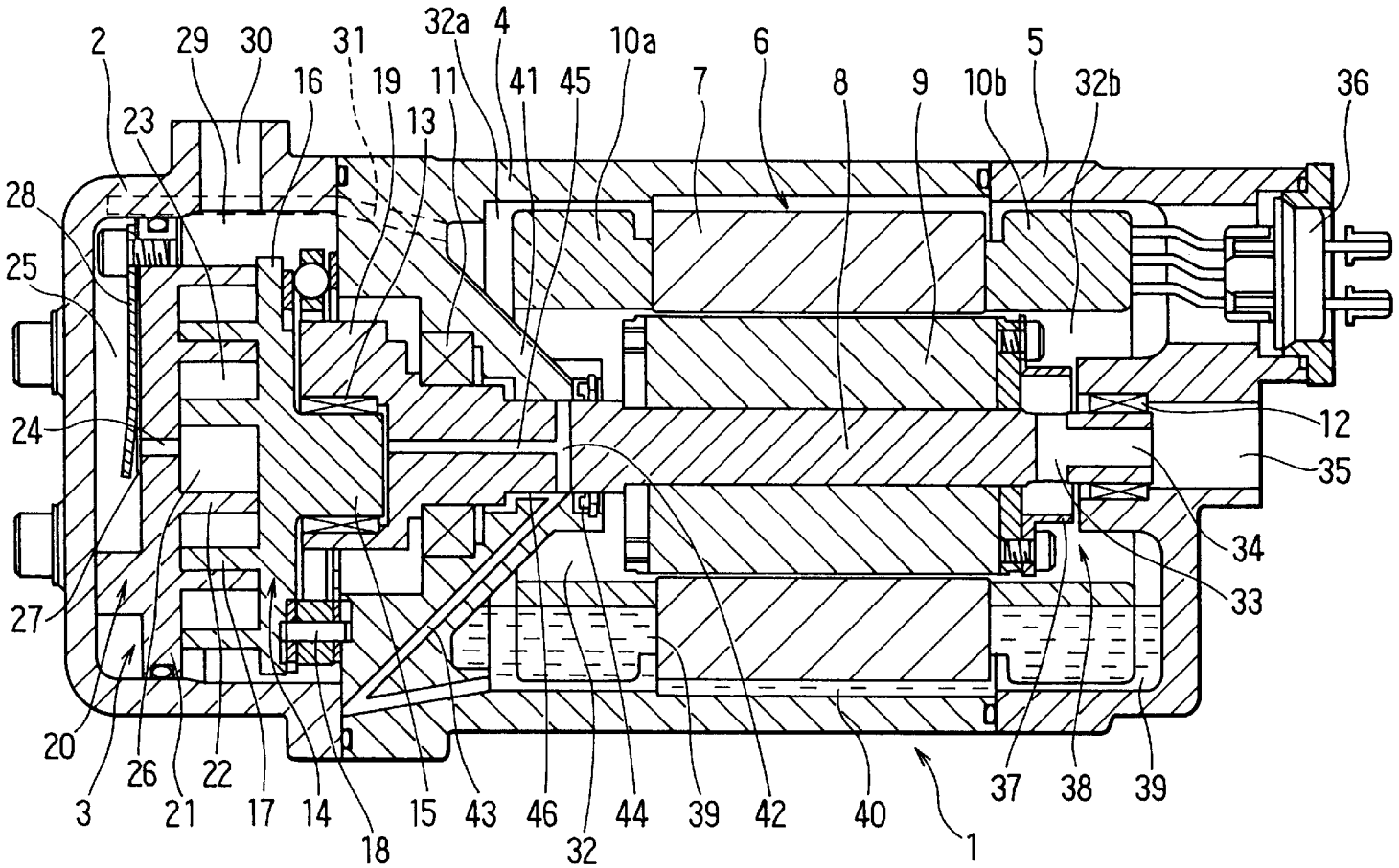
FIG. 2 is a sectional view of a related compressor.
Figure 3:
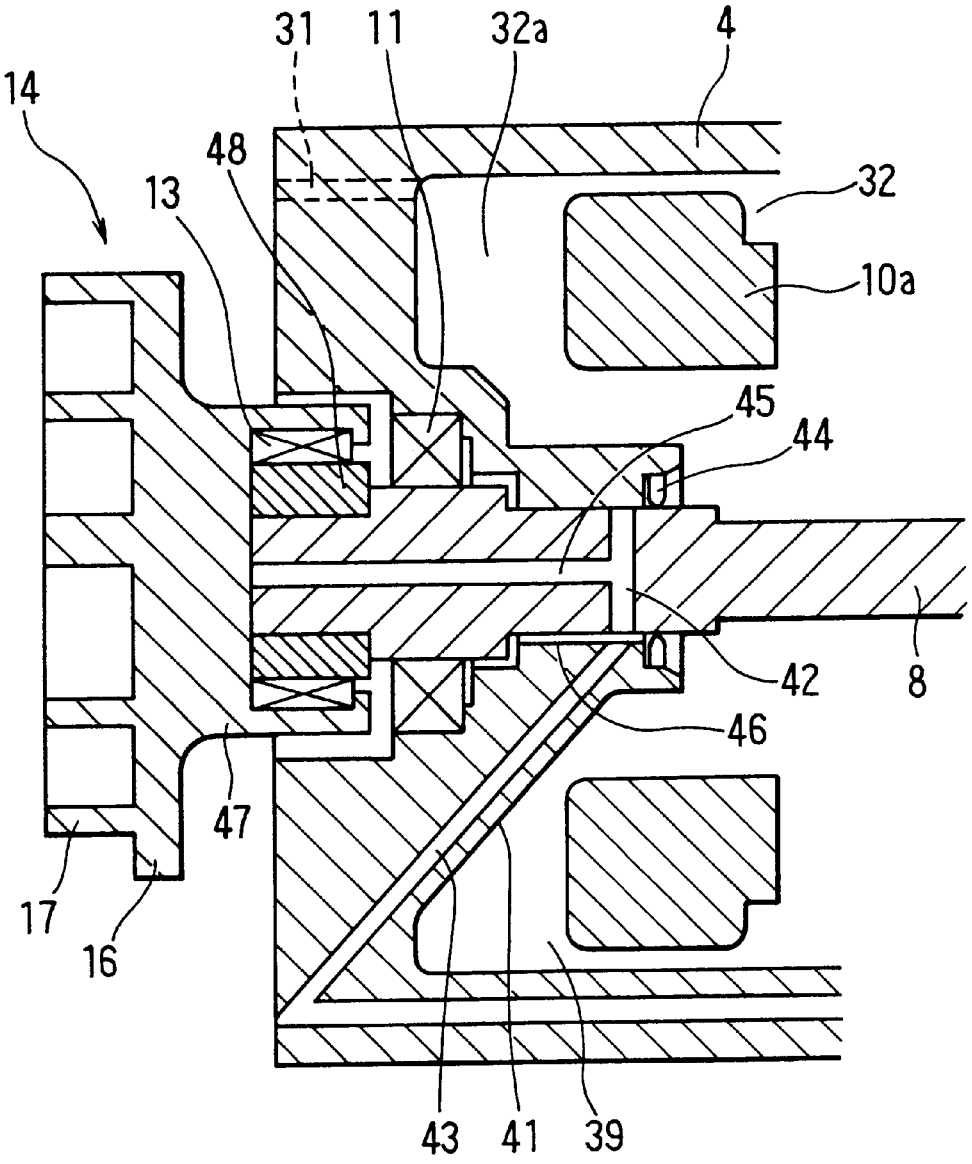
FIG. 3 is a main part of a sectional view of a related compressor.

FIG. 3 shows a corresponding portion of a related compressor to compare with the preferred embodiment in FIG. 1. FIG. 2 is a sectional view of a related compressor to explain the common structure between the preferred embodiment of the present invention and the related compressor. The main portion in FIG. 2 is similar as the one in FIG. 3. In FIGS. 1 to 3, components which are substantially the same as those in other Figures are assigned the same reference numerals.

Since the entire structure except the main feature shown in FIG. 1 is the same as those of the compressors shown in FIGS. 2 and 3, the common structure and operations among them will now be described according to FIG. 1.

An electrically-driven scroll type compressor 1 includes a scroll type compressor 3 housed in a front housing 2 and a motor unit 6 housed in a middle housing 4 and a rear housing 5. The front housing 2, the middle housing 4 and the rear housing 5 are integrally connected to form a housing.

The motor unit 6 includes a stator 7 installed in the middle housing 4 and a rotor (armature) 9 which rotates together with a rotation shaft 8. A coil 10 to produce magnetic field is wound around the stator 7, and has a front end 10*a* and a rear end 10*b*.

A front portion of the rotation shaft 8 is rotatably supported by a main bearing 11 installed in the middle housing 4. A rear portion of the rotation shaft 8 is rotatably supported by a rear bearing 12 installed in the rear housing 5.

On an eccentric position at the left end of the rotation shaft 8 in FIG. 2, a central shaft 15 of a movable scroll 14 is rotatably supported via a needle bearing 13. The movable scroll 14 has a movable end plate 16, which is a movable disk, and a scroll vane 17 formed in front of the movable end plate 16.

Well known thrust-support-rotation-inhibition-mechanism 18 is provided at the rear (right) of the movable end plate 16 to prohibit the axial movement and the rotation of the movable scroll 14. Accordingly, only the revolution of the movable scroll 14 is allowed. A balance weight 19 is formed in the left end of the rotation shaft 8 to balance the rotation shaft 8 with the movable scroll 14.

A fixed scroll 20 is fixed in the front housing 2 to oppose the movable scroll 14. The fixed scroll 20 has a fixed end plate 21 and a scroll vane 22 formed behind the fixed end plate 21. The fixed end plate 21 is a disk which is concentric with the rotation shaft 8 at a position extended from the front of the rotation shaft 8. The movable scroll vane 17 and the fixed scroll vane 22 are engaged each other to form several compression chambers 23 between them.

A discharge port 24 is formed in a central position of the fixed end plate 21. A discharge chamber 25 is formed in the front housing 2 in front of the fixed end plate 21. A central compression chamber 26 is formed when the compression chamber 23 is located at an approximately central portion of the movable scroll 14 and the fixed scroll 20. The discharge chamber 25 and the central compression chamber 26 are communicated via the discharge port 24.

A reed-shaped discharge valve 27 is installed in front of the fixed end plate 21 to close the discharge port 24 at an outside of the discharge port 24. A valve presser 28 presses the discharge valve 27.

A suction chamber 29 is formed in the front housing 2 at the outer periphery of the movable scroll 14 and the fixed scroll 20. When the electrically-driven scroll type compressor 1 is used as a compressor for refrigerant of an air conditioning apparatus, a suction port 30 may be connected to an evaporator for a refrigerant cycle via a pipe not shown, and refrigerant with low temperature and low pressure to be compressed is sucked into the suction chamber 29.

Compressed refrigerant in the compression chamber 23 between the movable scroll 14 and the fixed scroll 20 is introduced into the discharge chamber 25 by pushing and opening the discharge valve 27 via the central compression chamber 26 and the discharge port 24, and is introduced into a left end portion 32*a* of the motor chamber 32 formed in the middle housing 4 via a discharge passage 31 formed in a front housing 2 and the middle housing 4.

Right end portion 32*b* of the motor chamber 32 is formed in the rear housing 5. A through hole 33 in the radial direction and a discharge hole 34 connected to the through hole 33 in the axial direction are formed at a right end of the rotation shaft 8. The discharge hole 34 is communicated to the inside of the discharge port 35 formed on the rear surface of the rear housing 5. The discharge port 35 is connected to a condenser of the refrigerant cycle via a pipe not shown.

At the rear end of the rear housing 5, a connector 36 for supplying power to the coil 10 is provided next to the discharge port 35. A ring-shaped separator 37 is attached to the rotor 9 with a gap 38 remained between it and a bearing supporting portion of the rear housing 5 in order to separate the lubricant oil (refrigerating machine oil) from the refrigerant flowing into the through hole 33 of the rotation shaft 8 from the right end portion 32*b* of the motor chamber 32.

An oil storage chamber 39 for storing the lubricant oil separated from the refrigerant is formed at the lower portion of the motor chamber 32. Front portion and rear portion of the oil storage chamber 39 divided by the stator 7 are communicated by a communication hole 40 formed at a lower portion of the stator 7 in the axial direction.

Since the lubricant oil in the oil storage chamber 39 has a discharge pressure of the compressed refrigerant, such presser is utilized to supply the lubricant oil to the sliding portion at the front portion of the compressor 1. In order to supply the lubricant oil to the sliding portion at the front portion of the compressor 1, an internal oil supply passage 43 is formed in a protruding portion 41 and wall portion of the middle housing 4 to communicate the oil storage chamber 39 with the through hole 42 formed in the rotation shaft 8 in the radial direction.

The internal oil supply passage 43 can be always connected to the through hole 42 by providing a ring-shaped groove on the outer periphery of the rotation shaft 8 around the through hole 42. The ring-shaped groove, however, is not essential because a small gap exists between the surface of the rotation shaft 8 and an inner surface of the protruding portion 41 to pass the lubricant oil through the gap, or because the oil supply to the through hole 42 can be executed at intervals. To separate high pressure chamber side and low pressure chamber side, a shaft sealing device 44 is provided around the rotation shaft 8 at the tip of the protruding portion 41.

In a part of the shaft center of the rotation shaft 8, an oil supply hole 45 is formed in the axial direction to connect the through hole 42 to the left end of the rotation shaft 8 which houses the needle bearing 13 and the central axis 15 of the movable scroll 14. Accordingly, the lubricant oil in the oil storage chamber 39 having the discharge pressure passes through the internal oil supply passage 43 of the middle housing 4, and thereafter, a part of the lubricant oil is supplied to the needle bearing 13 via the through hole 42 and the oil supply hole 45. The lubricant oil supplied to the needle bearing 13 lubricates and cools the needle bearing 13, and flows to the thrust-support-rotation-inhibition-mechanism 18.

Another part of the lubricant oil passed through the internal oil supply passage 43 flows to the main bearing 11 via a lubricant oil groove 46 formed in an inner surface of the middle housing 4. The lubricant oil supplied to the main bearing 11 lubricates and cools the main bearing 11, and flows to the thrust-support-rotation-inhibition-mechanism 18.

Between the oil storage chamber 39 having the discharge pressure and the suction chamber 29 having the suction pressure, there is a suitable magnitude of flow resistance caused by a narrow path and the bearings. Accordingly, the necessary pressure difference between the discharge pressure and the suction pressure is maintained between the oil storage chamber 39 and the suction chamber 29.

As understood from FIGS. 2 and 3, they are not identical. The structure shown in FIG. 3 is closer to the preferred embodiment shown in FIG. 1. In other words, according to the related art shown in FIG. 2, a concave is formed at the left end of the rotation shaft 8, and the central shaft 15 is inserted into the concave to be supported via the needle bearing 13. To the contrary, according to the related art shown in FIG. 3, a hollow boss 47 is formed at the end plate 16, and the needle bearing 13 and an eccentric ring 48 are located inside the boss 47, and the left end portion of the rotation shaft 8 is fitted in the needle bearing 13 and the eccentric ring 48.

According to the related art compressors shown in FIGS. 2 and 3, when the rotation shaft 8 is rotated by supplying current to the motor unit 6, the movable scroll 14 does not rotate on its axis while revolving around the revolution center. Thus, the compression chamber 23 formed between the movable scroll 14 and the fixed scroll 20 shifts toward the center in the radial direction, and the volume of the compression chamber 23 is reduced. Accordingly, the refrigerant introduced into the compression chamber 23 is compressed when the compression chamber 23 is communicated with the suction chamber 29 at the outer periphery of the movable scroll 14 and the fixed scroll 20. The compressed refrigerant is discharged to the central compression chamber 26. When its pressure exceeds a predetermined pressure, the refrigerant is discharged to the discharge chamber 25 via the discharge port 24 by pushing out the discharge valve 27.

The refrigerant discharged to the discharge chamber 25 flows to the left end portion 32*a* of the motor chamber 32 via the discharge passage 31, and flows to the right end portion 32*b* via the gap of the motor unit 6, and flows into the through hole 33 via the gap 38 of the separator 37, and flows to the discharge port 35 from the discharge hole 34.

At the same time, the lubricant oil in the refrigerant is separated from the refrigerant, and is stored in the oil storage chamber 39, and flows to the internal oil supply passage 43 by pressure difference between the discharge pressure of the motor chamber 32 and the suction pressure of the suction chamber 29.

Since the separator 37, the through hole 33, and the like rotate, they prevent the lubricant oil having high density from flowing to the discharge hole 34, and the lubricant oil is separated from the refrigerant by centrifugal force.

According to the related art compressor described above, the lubricant oil having the discharge pressure in the oil storage chamber 39 is introduced to the through hole 42 via the internal oil supply passage 43, and is divided to the oil supply hole 45 and the lubricant oil groove 46 to supply the lubricant oil to the needle bearing 13, main bearing 11, thrust-support-rotation-inhibition-mechanism 18, and the like. Accordingly, the protruding portion 41 of the middle housing 4 protruding toward the motor unit 6 in the axial direction is large. As a result, the size and the shape of the protruding portion 41 prevent the reduction in size of the electrically-driven scroll type compressor 1.

In order to solve the above problem, the preferred embodiment of the present invention shown in FIG. 1 does not have the internal oil supply passage 43 to connect the oil storage chamber 39 and the through hole 42. Instead, the preferred embodiment of the present invention shown in FIG. 1 has an attachment groove 49 formed in a base portion of the protruding portion 41 for attaching the main bearing 11 thereon, and an internal oil supply passage 50 directly connected to the oil storage chamber 39.

Furthermore, in the preferred embodiment, a lubricant oil groove 51 is formed on the attachment groove 49 to communicate the attachment groove 49 with the lubricant oil groove 46.

According to the preferred embodiment shown in FIG. 1, the lubricant oil having the discharge pressure and stored in the oil storage chamber 39 is supplied to the attachment groove 49 via the internal oil supply passage 50, and is divided into two flows. One flows to the thrust-support-rotation-inhibition-mechanism 18 after passing, lubricating, and cooing the main bearing 11. The other flows to the through hole 42 via the lubricant oil grooves 51 and 46, and flows to the needle bearing 13 via the oil supply hole 45, and flows to the thrust-support-rotation-inhibition-mechanism 18. Although the flow order of the preferred embodiment is different from the one of the related art shown in FIG. 2 or FIG. 3, the lubrication performance and the cooing performance are the same among them.

According to the preferred embodiment shown in FIG. 1, the internal oil supply passage 43 is obviated, and the internal oil supply passage 50 is formed to be directly connected to the attachment groove 49. Accordingly, protrusion amount of the protruding portion 41 in the axial direction of the middle housing 4 is reduced, and the coil front end 10*a* gets closer to the front end of the middle housing 4. The original positions of the coil front end 10*a* and the internal oil supply passage 43 of the related art compressor are shown by two-dot chain line in FIG. 1. Thus, the axial length of the electrically-driven scroll type compressor 1 is reduced.

Although the present invention is applied to a scroll compressor in the preferred embodiment, it is also applied to other electrically-driven scroll type compressors having different types of compressors, such as one having a protruding portion 41 which is formed by protruding a part of the housing from the compressor unit toward the motor unit to install a bearing such as the main bearing 11.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An electrically driven compressor apparatus for compressing fluid, comprising:

an electric motor having a rotation shaft;

a compressor integrally connected to said electric motor to be driven by said electric motor via said rotation shaft;

a housing for accommodating said electric motor and said compressor;

a housing protruding portion protruding toward said electric motor from said compressor in an axial direction at a periphery between said electric motor and said compressor to support said rotation shaft by said housing;

an oil storage chamber for storing lubricant oil separated from compressed fluid;

an attachment groove formed at a base portion of said housing protruding portion;

a bearing installed in said attachment groove for rotatably supporting said rotation shaft; and an internal oil supply passage formed in said housing for introducing said lubricant oil separated from compressed fluid and stored in said oil storage chamber to said attachment groove in such a manner that said lubricant oil separated from compressed fluid and stored in said oil storage chamber is directly supplied to said bearing.

2. An electrically driven compressor apparatus as in claim 1, wherein;

said electrically driven compressor apparatus includes at least one sliding portion to be lubricated; and said electrically driven compressor apparatus includes a lubricant oil passage to introduce said lubricant oil from said attachment groove to said sliding portion.

3. An electrically driven compressor apparatus as in claim 1, wherein;

said electrically driven compressor apparatus includes at least one sliding portion to be lubricated; and said lubricant oil flows from said bearing to said sliding portion.

4. An electrically driven compressor apparatus as in claim 1, wherein said compressor is a scroll-type compressor.

5. An electrically driven compressor apparatus for compressing fluid, comprising:

an electric motor having a rotation shaft;

a bearing fitted around said rotation shaft for supporting said rotation shaft rotatably;

a compressor provided at one axial side of said electric motor and coupled with said rotation shaft to be driven for compressing a fluid and discharging the same through said electric motor;

an oil storage chamber provided in said electric motor for storing lubricant oil separated from said compressed fluid;

a cylindrical wall encircling said electric motor and having a first oil return passage communicated with said oil storage chamber; and a side wall provided integrally with said cylindrical wall between said electric motor and said compressor and having a protrusion for fixedly supporting said bearing therein;

wherein said protrusion has a second oil return passage communicating said first oil return passage to said bearing so that said separated lubricant oil is returned directly to said bearing.

* * * * *